US006951113B1

(12) United States Patent
Adamski

(10) Patent No.: US 6,951,113 B1
(45) Date of Patent: Oct. 4, 2005

(54) VARIABLE RATE AND CLARITY ICE MAKING APPARATUS

(75) Inventor: Joseph Adamski, Pasadena, CA (US)

(73) Assignee: Joseph R. Adamski, Pasadena, CA (US)

( * ) Notice: Subject to any disclaimer, the term of this patent is extended or adjusted under 35 U.S.C. 154(b) by 0 days.

(21) Appl. No.: 10/757,026

(22) Filed: Jan. 13, 2004

Related U.S. Application Data

(60) Provisional application No. 60/439,620, filed on Jan. 14, 2003.

(51) Int. Cl.[7] ..... F25B 21/02
(52) U.S. Cl. ..... 62/3.62; 62/66; 62/233; 62/353
(58) Field of Search ..... 62/3.62, 66–74, 62/135–138, 340–356, 233

(56) References Cited

U.S. PATENT DOCUMENTS 4,487,024 A * 12/1984 Fletcher et al. ..... 62/3.63
5,157,929 A * 10/1992 Hotaling ..... 62/66

* cited by examiner

*Primary Examiner*—William E. Tapolcai
(74) *Attorney, Agent, or Firm*—Needle & Rosenberg, P.C.

(57) ABSTRACT

The icemaker presented here may use a microcontroller, and solid state refrigeration and heat transfer elements to create ice cube qualities ranging from "clear ice" to "fast ice" in a smooth, user selectable continuum. In one embodiment, this may be accomplished by fitting a standard, high production volume icemaker mold with (1) thermoelectric coolers operated in a controlled fashion to heat or cool the mold, (2) a mold temperature sensor (such as a thermistor), and (3) a microcontroller to monitor the process and to adjust the growth rate of ice forming in the mold by adjusting heat transfer rates to optimize particular cooling phases.

43 Claims, 9 Drawing Sheets

OVERALL ICEMAKING PROCESS FLOW CHART

FILL PROCESS

INLET WATER COOLING PROCESS

CLEAR ICEMAKING PROCESS

ICE CUBE SUB-COOLING PROCESS

HARVEST PROCESS

VARIABLE RATE AND CLARITY ICE MAKING APPARATUS

CROSS-REFERENCE TO RELATED APPLICATION

The benefit of the filing date of U.S. Provisional Application No. 60/439,620, filed Jan. 14, 2003, and entitled "Variable Rate and Clarity Icemaking Apparatus", is hereby claimed, and the specification thereof is incorporated herein in its entirety by this reference.

BACKGROUND OF THE INVENTION

1. Field of the Invention

This invention generally relates to an automatic icemaker, and more specifically to an improved icemaker for creating ice cubes in a user selectable continuum of qualities which may be judged to be between either "fast" in freezing rate or "clear" in appearance, or some combination thereof.

2. Description of the Related Art

The typical icemaker found in the kitchen refrigerator is located in the freezer section of the appliance. In its simplest form, water is introduced into a mold, frozen, and then harvested into a container positioned beneath the mold. In more complicated systems, ice is made in a mold, harvested into a bucket, transported to a delivery or exit port using a motorized auger, crushed or left intact, and delivered on demand to a drinking vessel or other container held by the user.

Ice making can be regarded as a three part process. In the first part of the process, sensible heat is removed from water which has been directed into the mold, until the water is nearly at its freezing temperature of 32° F. The term "sensible heat" has the same meaning as "enthalpy"; namely the heat absorbed or transmitted by a substance during a change of temperature which is not accompanied by a change of state.

The second part is the ice making process, additional heat (usually called the latent heat of fusion—144 BTU/lb) is removed from the water as it changes state from 32° F. water to 32° F. ice. In the third part of the process, the remaining sensible heat is removed and the 32° F. ice is further cooled to harvest temperature (often below 32° F. to perhaps as low as 0° F.) for delivery to the awaiting ice bin, bucket or suitable container.

To reduce the time it takes to freeze water to ice which can be harvested, refrigeration engineers incorporate design features in the ice making system that direct the highest volume of the coldest air (available in the freezer section of the kitchen refrigerator) into the icemaker cube mold area. Water in the ice cube mold is frozen as quickly as possible, harvested to the bucket or container, and the mold automatically refilled with water. This sequence of freeze-harvest-refill events results in the most "pounds per hour" of ice possible; however, rapid freezing directly contributes to the creation of cloudy ice.

Cloudy ice forms for a number of reasons, but perhaps the most significant is because impurities in the source water are entrained in the rapidly freezing ice-front present in the cube. This is because the typical water freezing rate exceeds the diffusion rate of the impurities in the water (typically dissolved gases such as nitrogen or carbon dioxide) and the freeze front direction is not well controlled.

In-line carbon block water filters typically supplied with automatic icemakers remove particulates and improve taste and odor of water caused by chlorine. However, these filters are not capable of removing significant amounts of dissolved gas, nor are fluid metering systems able to control the amount of gas re-dissolved into the mold water during the simple act of refilling.

Slow freezing usually creates clear ice, but typically available water spray or freezing tube clear ice systems are available only as commercial icemakers and are not suitable for general residential home use due to higher initial costs, higher installation costs and higher maintenance costs. Perhaps more importantly, there is a consumer need for ice which meets the occasion of its use—if ice for a portable picnic cooler is needed, the clearest possible ice is usually not necessary—nor is the cloudy, fast ice acceptable for a scheduled evening cocktail party.

To create ice cubes of a quality that better meets consumer requirements, the most important part of the ice making system needing improvement is the mold and associated design elements—referred to from this point on as the icemaker. Once ice is created that meets the quality expectations of the consumer, ice cube storage and ice cube delivery can be addressed in a number of ways.

BRIEF SUMMARY OF THE INVENTION

The icemaker presented here may use a microcontroller, and solid state refrigeration and heat transfer elements to create ice cube qualities ranging from "clear ice" to "fast ice" in a smooth, user selectable continuum. In one embodiment, this may be accomplished by fitting a standard, high production volume icemaker mold with (1) thermoelectric coolers operated in a controlled fashion to heat or cool the mold, (2) a mold temperature sensor (such as a thermistor), and (3) a microcontroller to monitor the process and to adjust the growth rate of ice forming in the mold by adjusting heat transfer rates to optimize particular cooling phases.

One important feature of the invention is that the sensible heat removal portions of ice cube making at the beginning and end of the process are accelerated with no impact on clarity of the cube, and the latent heat removal portion of the ice making process is accurately controlled to grow the clearest ice possible.

Using the design elements indicated above, heat is rapidly removed from water metered into the mold by a combination of convective heat transfer from available low temperature freezer air and conductive heat transfer from thermoelectric coolers directly attached to the mold. Once the water is at freezing temperature, the thermoelectric coolers are changed from cooling to heating mode to slow the freezing process, control the direction of ice front growth and create clear ice. After all the water in the mold is frozen, the thermoelectric coolers are changed from heating to cooling mode to further remove sensible heat from the ice until harvest temperature is achieved. Finally, the thermoelectric coolers are changed from cooling to heating mode to warm the mold, melt the ice-water interface and allow the cube to be slipped out of the mold on the low friction water present at the ice/mold interface. The water temperature is monitored using a temperature sensor attached to the mold, and the cooling, freezing, sub-cooling and harvest activity is initiated, controlled and terminated using the on-board microcontroller.

DETAILED DESCRIPTION OF THE INVENTION

Figure 1:
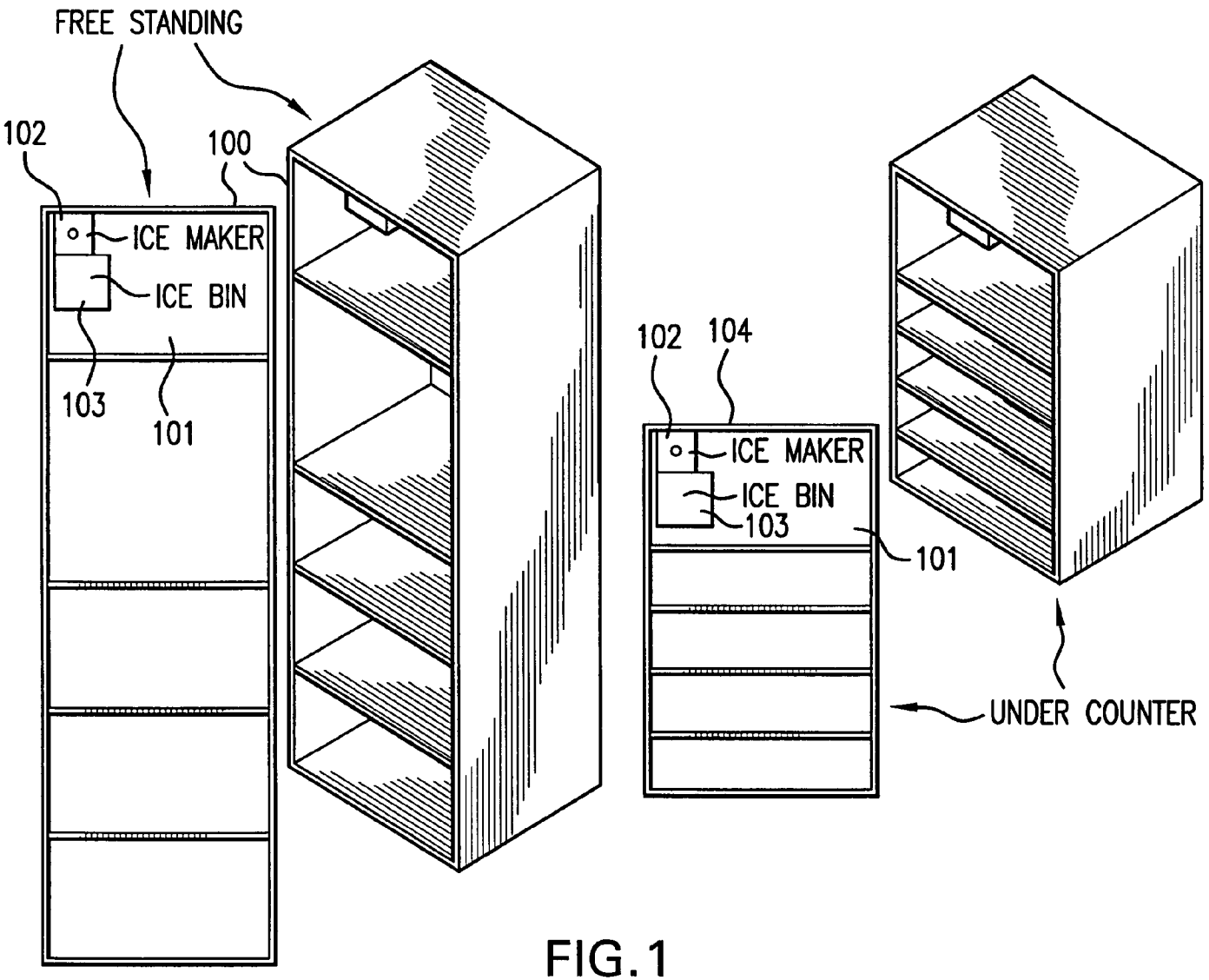
FIG. 1. shows front and perspective views of the freezer section of a side by side refrigerator and an undercounter refrigerator containing the icemaker.

FIG. 1 shows a standard icemaker 102 located in a standard freezer section 101 of a refrigerator 100. Ice bin 103 positioned under icemaker 102 is provided to receive harvested ice. In different embodiments, the icemaker may be installed in but not limited to the freezer section of a side by side refrigerator or bottom mount refrigerator (a refrigerator with freezer section located in the drawer). It is contemplated that the present invention may also be practiced in other types of refrigerators, such as undercounter refrigerator 104 as well as icemaking machines. A further unique application of the invention is that it may be installed in the "fresh food" or "refrigerated" section of a refrigerator.

Figure 2:
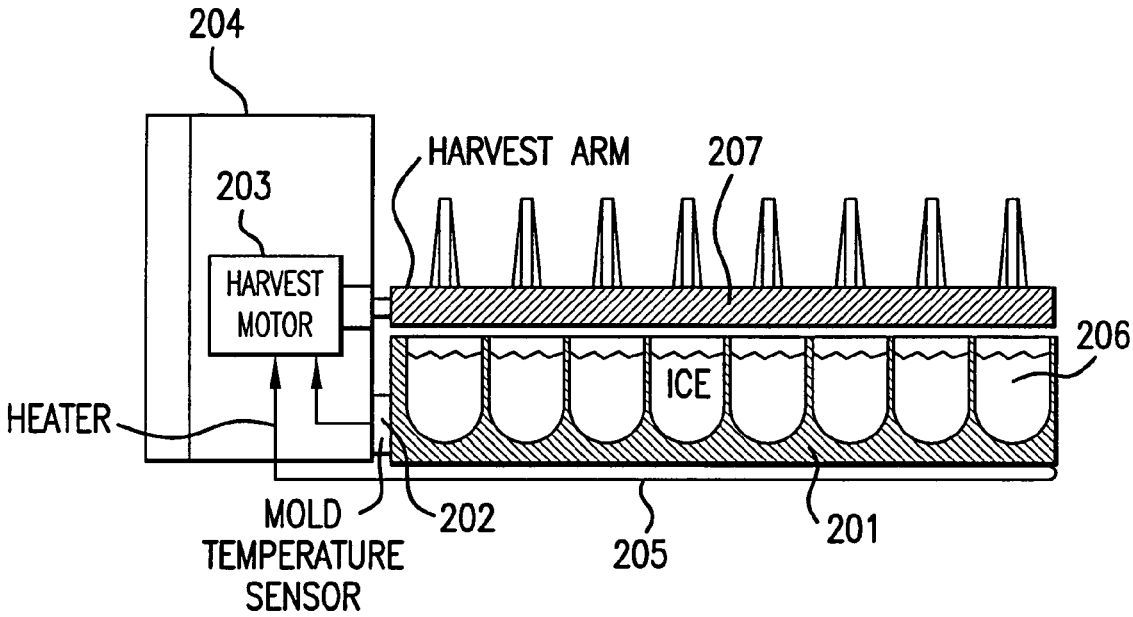
FIG.2 PRIOR ART
FIG. 2. is a part schematic side elevational view of a typical icemaker.

FIG. 2 is a schematic elevational cross section of a typical prior art icemaker. Metal mold 201 is provided for holding water 206 and creating the shape of the ice cube. A time-metered amount of water is introduced into mold 201 and the liquid flows through channels located between individual cubes to establish a uniform level. In the presence of freezer air, the water is quickly cooled to freezing temperature, then to ice temperature and further sub-cooled to harvest temperature. Thermal snap switch 202 is provided to detect the temperature of the mold. When harvest temperature is reached, thermal snap switch 202 closes and applies electric power to harvest motor 203 located in drive housing 204 and heater 205 positioned in thermal contact with the mold. Heater 205 raises the temperature of the mold sufficiently to melt the ice/mold interface, and simultaneously, harvest motor 203 turns harvest arm 207 which slowly scoops out the ice cubes. The cubes slide out of the mold and fall into an awaiting bucket or container. Harvest arm 207 continues to rotate to an idle position, where timer cams operate a microswitch allowing a water valve to be opened and at a preset later time closed. This cam meters an amount of water to be introduced into mold 201. The combined residual heat of the recently harvested mold and newly introduced water is sufficient to reset the mold thermal snap switch 202. Electric power is removed from harvest motor 203 when an additional microswitch encounters the motorized cam and de-energizes the motor.

Figure 3:
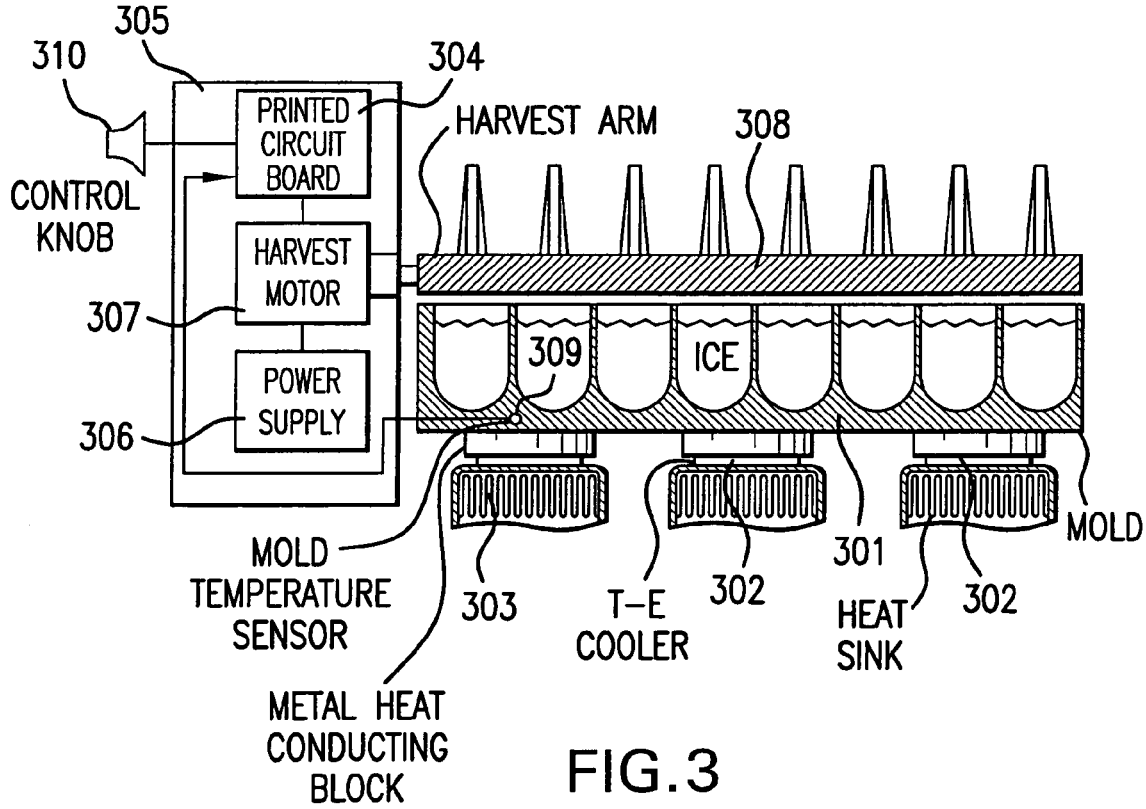
FIG. 3. is a part schematic side elevational view of subject icemaker invention.

FIG. 3 is a schematic elevational cross section of the subject invention icemaker. The icemaker has a metal mold 301 for holding water and shaping the ice cubes. One or more heat transfer devices, such as thermoelectric coolers 302, are attached in thermal contact to mold 301. The other side of the cooler 302 is in thermal contact to finned heat sink 303 or other suitable heat sinking surface. A microcontroller located on printed circuit board 304 in drive housing 305 executes the process control program. A power supply 306 (such as a DC power supply) located in drive housing 305 operates the microcontroller as well as the thermoelectric coolers 302. Harvest motor 307 may be operated from standard 120 VAC line voltage or from DC available from the power supply 306. The water fill valve may also be operated from 120 VAC line voltage or from DC. A harvest arm 308 is fixed to harvest motor 307 for scooping out the ice cubes during the harvest cycle. A mold temperature sensor 309 may be a thermistor and detects the temperature of mold 301 during the fill, freeze and harvest periods of the process.

Figure 4:
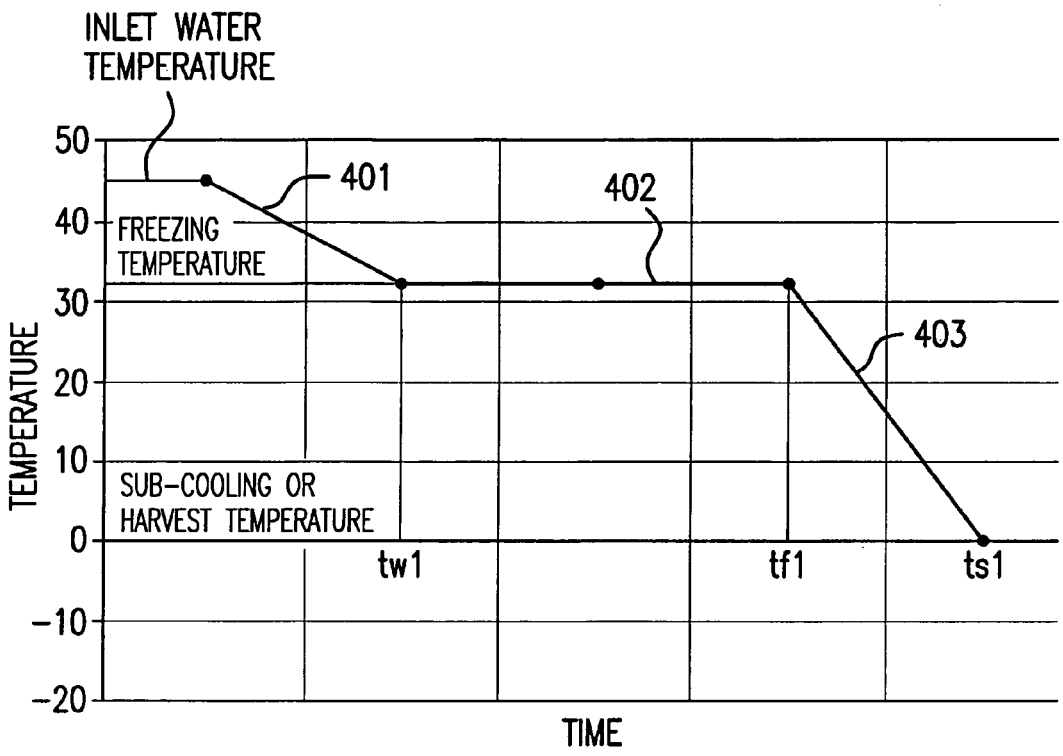
FIG.4 PRIOR ART
FIG. 4. is a representative graph of the time/temperature relationship of the prior art icemaking process.

FIG. 4 is a typical graph of the temperature vs. time relationship of the prior art ice cube making process (such as used in the prior art device of FIG. 2). At the beginning of the process, water is introduced into the mold at a temperature generally above the freezing point of water but typically ranging in temperature from 70° F. to 38° F. Heat is removed from the water present in the mold by convective heat transfer with the cold air present in the vicinity of the mold. During this sensible heat removal portion of the cycle, a 1° F. change in temperature results from 1 BTU of heat being removed from 1 pound of water. This temperature change is shown as segment 401. The time to accomplish this sensible heat removal is labeled $t_{w1}$.

Once the water reaches the temperature of 32° F., the process continues, governed by the latent heat of fusion required to transform water to ice—144 BTU/pound. The temperature of the water remains at 32° F. until it becomes 32° F. ice at time $t_{f1}$. This segment of the process is labeled 402. From that point onward, sensible heat continues to be removed from the now water turned ice, and the cubes are sub-cooled at a rate depicted in segment 403 until the harvest temperature is attained at time $t_{s1}$.

Figure 5:
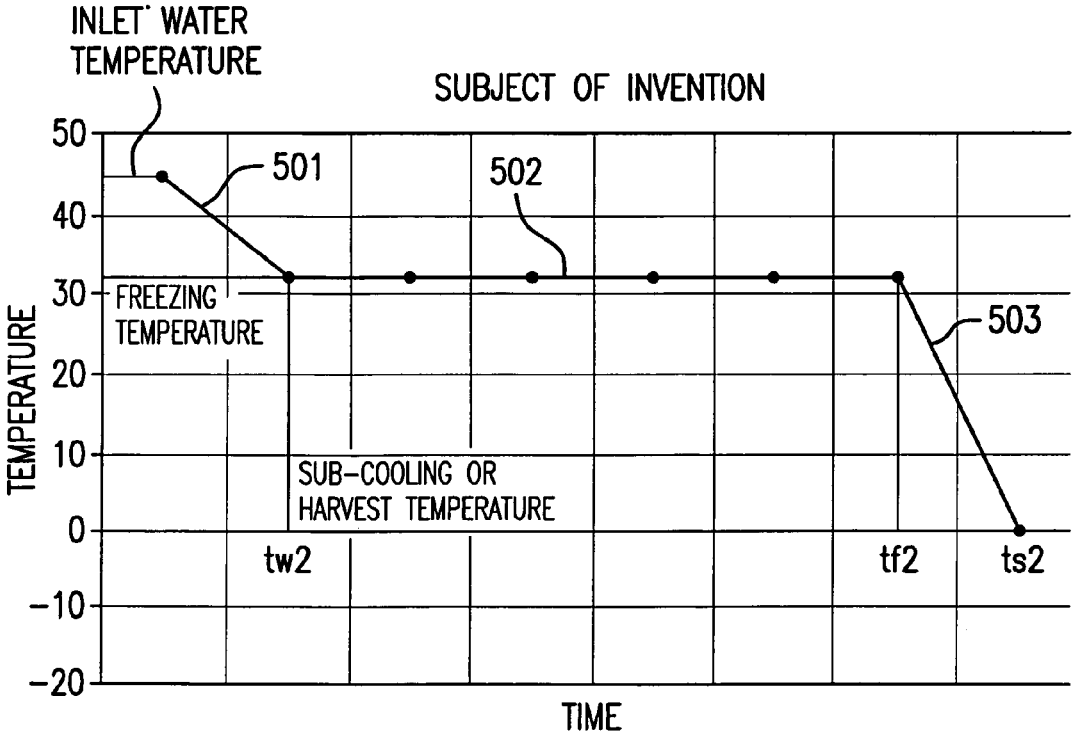
FIG. 5. is a representative graph of the time/temperature relationship of the subject icemaker invention icemaking process.

FIG. 5 is a typical graph of the temperature vs. time relationship of the subject invention icemaker depicted in FIG. 3. As in the prior art, at the beginning of the process water is introduced into the mold at a temperature generally above the freezing point of water but typically ranging in temperature from 70° F. to 38° F. Sensible heat is removed from the water present in the mold by a combination of convective heat transfer with the cold air present in the vicinity of the mold and conductive heat transfer resulting from the heat pump effect of the thermoelectric coolers 302. The result is a rapid cool down 501 to freezing temperature ($t_{w2}$), wherein $t_{w2}$ is substantially smaller than the $t_{w1}$ of the prior art (FIG. 4).

This time reduction occurs because the conductive heat transfer rate of the subject invention is much higher than the convective heat transfer rate of prior art. Furthermore, in this mode of operation, the thermoelectric coolers 302 create a mold interface temperature as low as −40° F. Since the heat transfer rate is directly related to the product of the heat transfer coefficient and the temperature difference present between the heat source and sink, the rate is significantly increased over the prior art rate resulting from 0° F. to 5° F. temperatures being present in the freezer section of appliances.

During the latent heat of fusion removal portion of the ice making process 502, the time to make ice depends directly on the heat removal rate. If the heat removal rate is low, ice grows slowly. Similarly, if the heat removal rate is high, ice grows quickly. Since typical freezer sections of refrigerators in which the subject invention icemaker is operated create conditions for high heat removal, ice grows quickly unless heat is reintroduced into the mold. The $t_{f2}$ of the subject invention icemaker (time to freeze) may be shorter if the thermoelectric coolers 302 are operated to pump heat at a higher rate than possible in prior art designs, or longer than $t_{f1}$ of prior art icemaker designs if the thermoelectric coolers are operated in a reverse polarity to supply heat to the mold. Fast ice or clear ice is made by controlling this heat transfer rate.

Finally, the time to harvest $t_{s2}$ as the ice cube is sub-cooled 503 below 32° F. is shorter in the subject invention icemaker (FIG. 3) than in the prior art (FIG. 2). To accomplish this, the thermoelectric coolers 302 are set to remove heat by conductive heat transfer from the mold at a rate substantially higher than present in convective heat transfer of prior art icemakers.

The result of this configuration of elements is an icemaker which exhibits variable icemaking rate (pounds/hour) as well as cube clarity, resulting from the speed with which 32° F. water is transformed into 32° F. ice.

Figure 6:
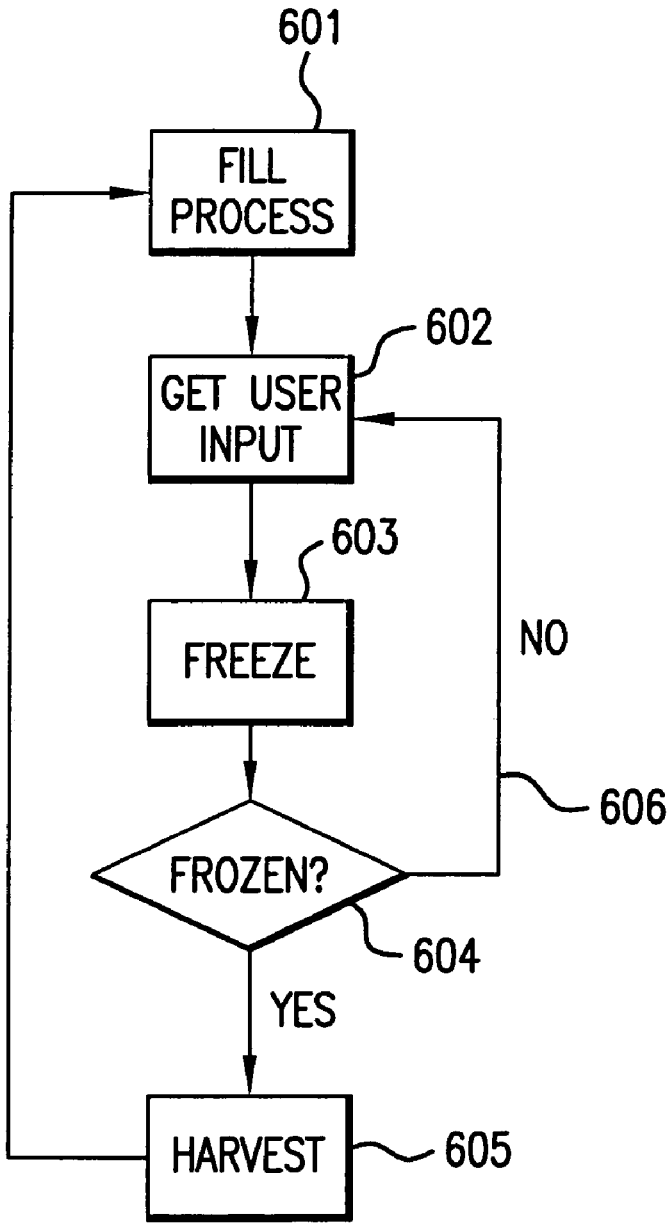
FIG. 6. is a flow chart of the overall icemaking process.

FIG. 6 is a flow chart of the general ice making process executed by the microcontroller 304 present in the subject invention icemaker. In 601, the mold is filled with water. The status of a human interface device 310 such as potentiometer, slide switch, keyboard input, touch screen, etc. (but not limited to these human interface devices) is obtained in 602 to indicate to the microcontroller 304 if the user desires clear ice, fast ice or a quality of ice in between those two endpoints. This status is may be, in one embodiment, a numeric representation (typically ranging from −100 to +100 or −127 to +127 or 0 to 255), of the angular or linear position of human interface device 310 (in the case of a potentiometer), or a numeric representation formed from combining successive keypad entries.

Of course, human interface device 310 may take many forms, and the above are simply examples. Furthermore, the range of travel of the human interface device 310 may be interpreted as containing user selections ranging from clear ice, fast ice or a quality of ice in-between, but not limited to those two points.

Once the user input has been read by microcontroller present on printed circuit board 304, the value determines the quantity of heat applied to mold 301 to slow the freeze process and create clear ice, or the quantity of heat to be removed from mold 301 to accelerate the freeze process and create fast ice.

In the case when user input device 310 creates an ice quality request ranging from −100 to 100, settings in the range −100 to 0 may in one embodiment be considered to be the duty cycle of DC power from power supply 306 applied to thermoelectric coolers 302 to create clear ice by heating mold 301. For example, if the total time period of the duty cycle is considered to be 10 minutes, the −100 value may correspond to DC power continuously applied to thermoelectric cooler 302 in a heating mode; a −50 value may correspond to DC power applied for 5 minutes followed by an off time period of 5 minutes; a −30 value may correspond to DC power applied for 3 minutes followed by an off time period of 7 minutes, and so on.

Similarly, settings in the range 0 to +100 may be considered to be the duty cycle of DC power applied to thermoelectric cooler 302 to create fast ice by setting the appropriate polarity of DC voltage applied to the thermoelectric coolers to conductively cool mold 301, perhaps in combination with convection cooling available from the ambient available in the kitchen appliance containing the subject invention icemaker. For example, if the time period of the duty cycle is considered to be 10 minutes, the 0 value may correspond to DC power continuously applied to thermoelectric cooler 302 in a cooling mode for 0 minutes followed by an off time period of 10 minutes; a 30 value may correspond to DC power applied continuously for 3 minutes followed by an off time period of 7 minutes; a 70 value may correspond to DC power applied for 7 minutes followed by an off time period of 3 minutes, and so on.

Again, and as will be appreciated by one of ordinary skill in the art, the above values and duty cycles are simply representative examples, and should not be considered limiting. A wide variety of other values and duty cycles may be used as well.

In 603, the desired quality of ice is created by controlling the heat transfer rate during the state change process using the thermoelectric coolers 302 as heat sources or heat sinks for the icemaker mold 301. In 604, the mold temperature sensor 309 detects the temperature of the material present in the mold 301. If the ice is not frozen, in branch 606 the human interface device 310 is queried in 602 for new or unchanged requirements and the heat transfer process in 603 is either left unchanged or modified. In 604, if the ice is frozen, a harvest process 605 is executed. After the completion of the harvest process 605, the flow of control passes back to the fill process of 601. The process depicted in FIG. 6 is merely illustrative of one embodiment of a process for making ice according to the teachings of the present invention.

Figure 6A:
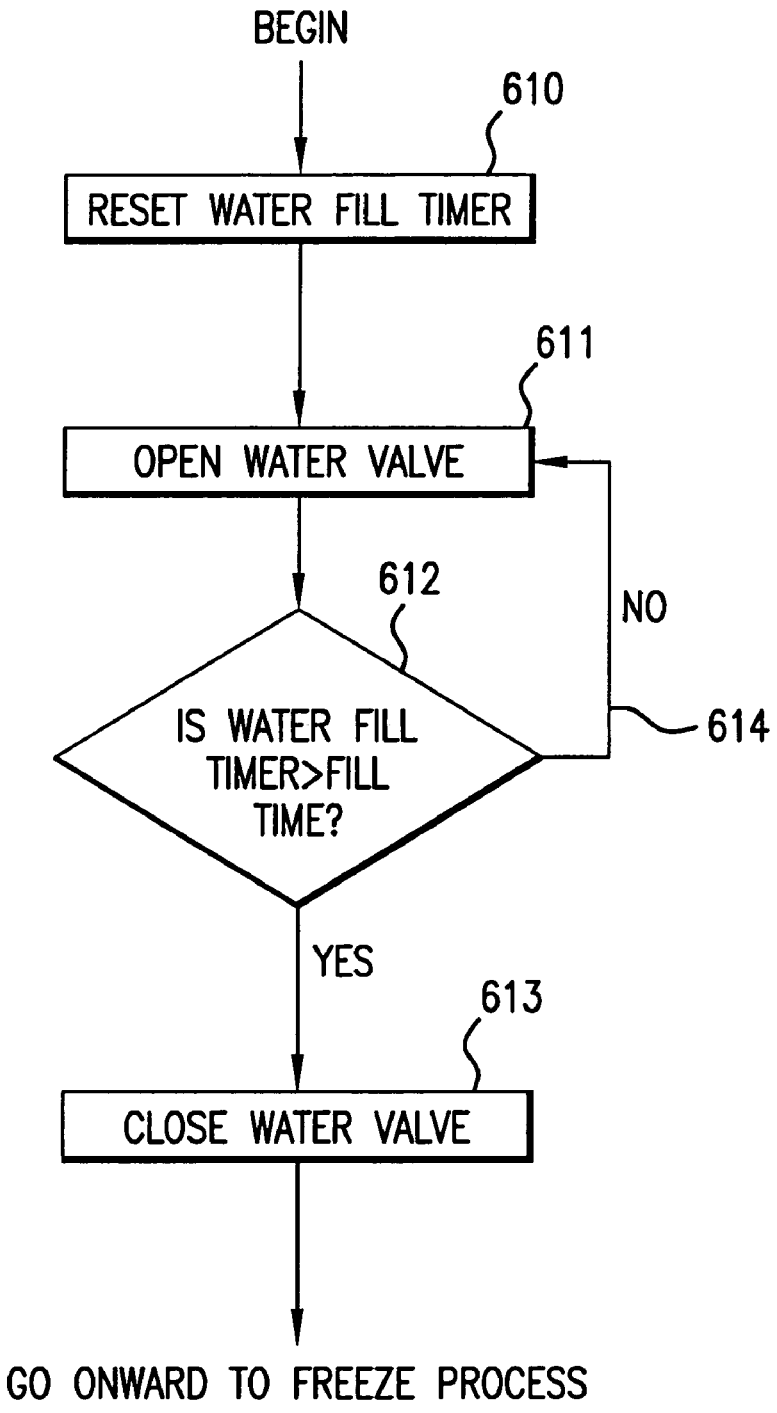
FIG. 6A is a flow chart of the fill process.

FIG. 6A describes the fill process, in one embodiment. In 610, an internal variable, called the water fill timer, and representing water valve open time, is set to a value of 0. After that occurs, the water valve is opened as indicated in 611. A decision is made in 612 based on the value of the water fill timer which is periodically incremented by the microcontroller 304, and is representative of the real elapsed time of the process. If the water fill timer is smaller in magnitude than a preset variable called fill time (branch 614), the water valve remains open (611). If the water fill timer is greater in magnitude than the preset fill time, the water valve closes as in 613 and flow of control passes onward to the freeze process (FIG. 6B).

Figure 6B:
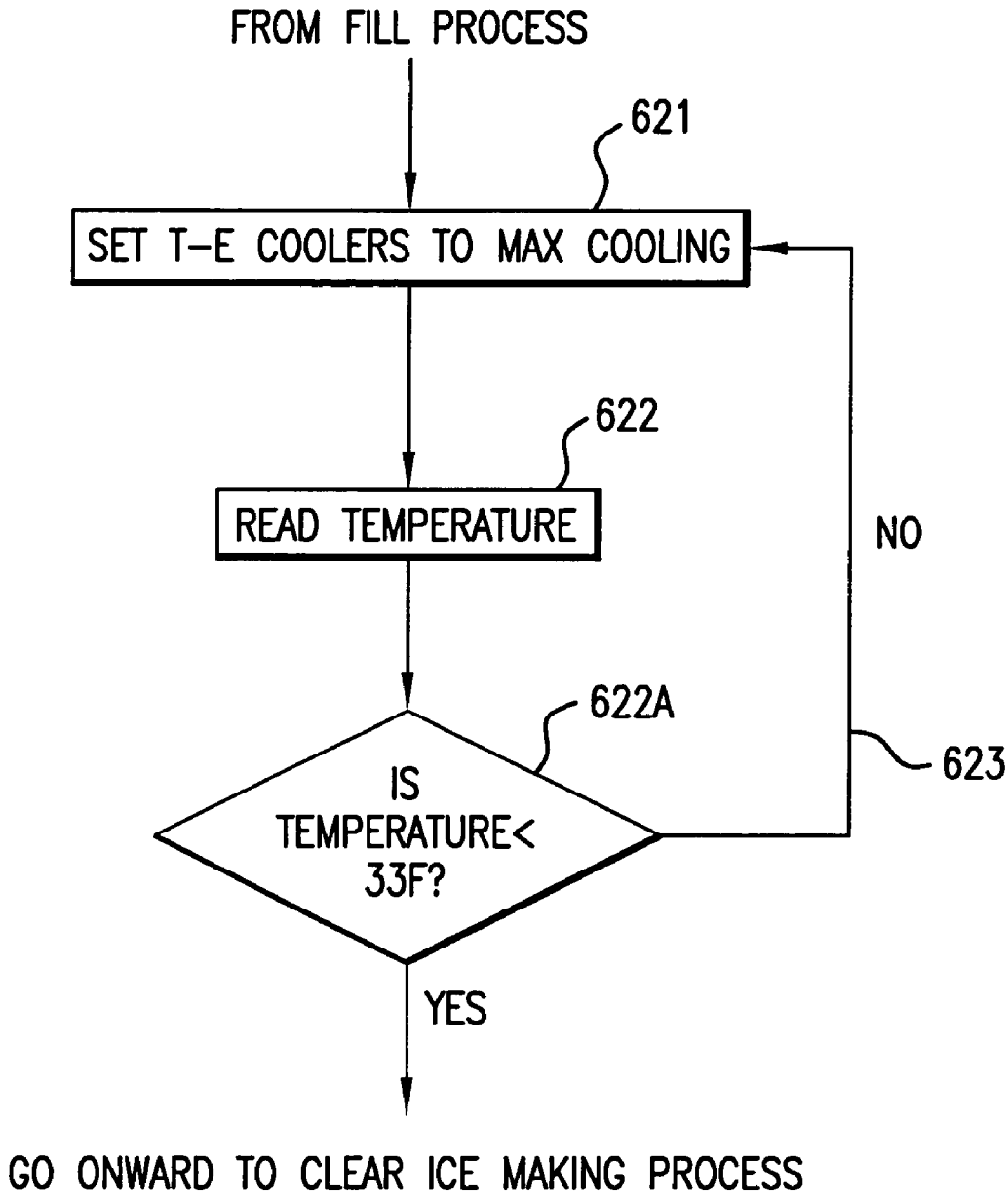
FIG. 6B is a flow chart of the inlet water cooling process.

FIG. 6B schematically describes the inlet water cooling process. In 621, the microcontroller 304 sets the polarity of the DC voltage available from power supply 306 applied to thermoelectric coolers 302 to cause maximum heat extraction from the icemaker mold 301. In 622, the temperature of the mold 301 is measured using mold temperature sensor 309. In 622A, if the actual temperature is greater than or equal to 33° F., thermoelectric coolers 302 will continue cooling and the mold 301 temperature will be periodically re-measured as depicted in branch 623. If the actual temperature is less than 33° F., the inlet water cooling process is complete and flow of control passes onward to the clear icemaking process shown in FIG. 6C.

Figure 6C:
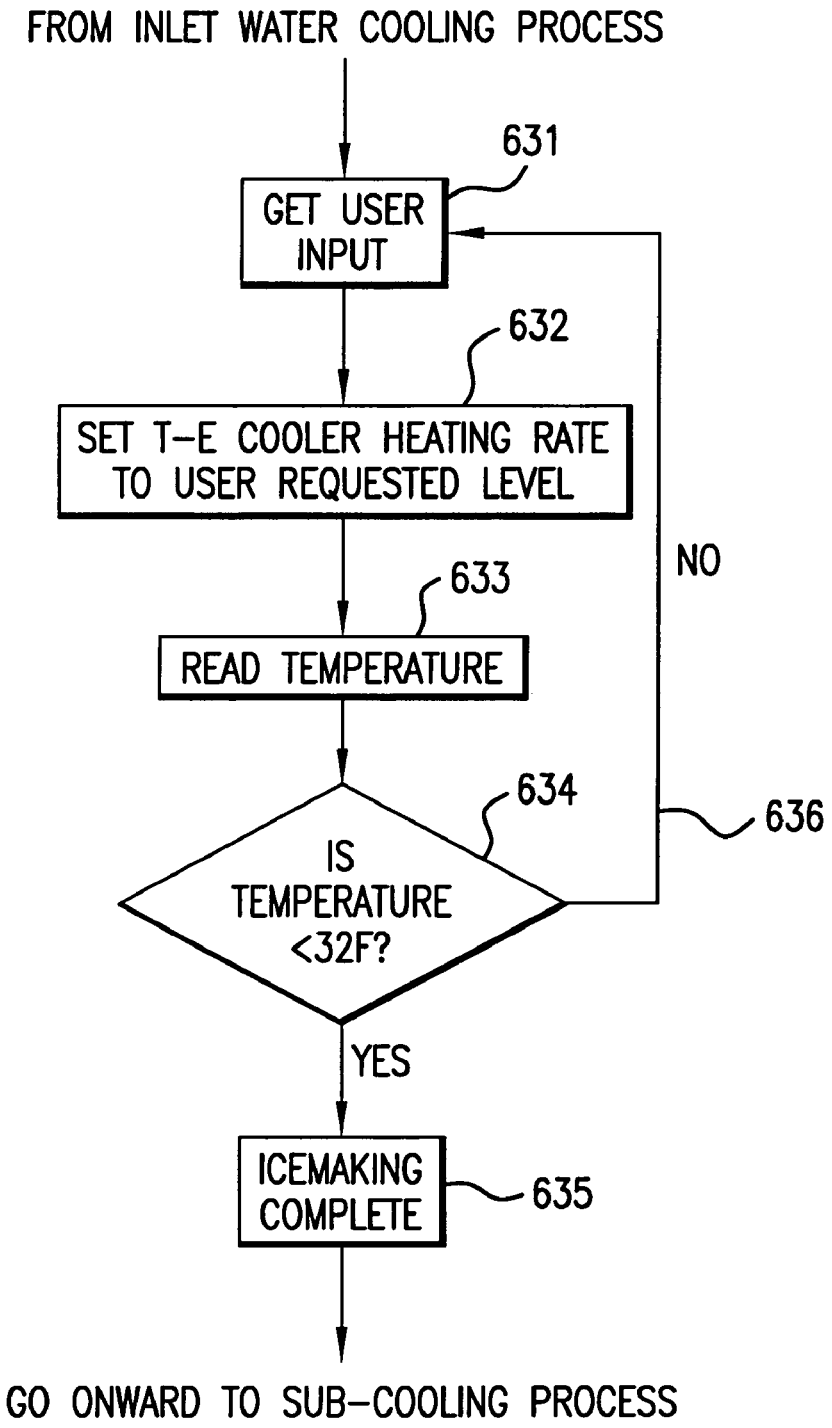
FIG. 6C is a flow chart of the clear icemaking process.

FIG. 6C is a flow chart showing the activity and decisions made by the microcontroller located on printed circuit board 304 to create the quality and rate of ice requested by the user. In 631 the position of a human interface device 310 such as a potentiometer or keyboard keystroke is detected and translated into an internal variable representative of the heat removal rate required to achieve the user input request. The thermoelectric cooler 302 heat removal rate is set to the user requested level in process block 632.

In one extreme setting of the input potentiometer 310, the thermoelectric coolers 302 are operated as cooling devices. In the other extreme setting of the input potentiometer 310, the thermoelectric cooler duty cycle is adjusted to maintain the mold 301 temperature slightly below the freezing temperature of water—as either heat source or heat sink. The temperature of the mold 301 is measured in process block 633. In 634, a decision is made to continue the ice growth process at the user selected rate (branch 636) or terminate the process if the mold temperature is less than 32° F. When ice making is complete 635, flow of control moves onward to the sub-cooling process (FIG. 6D).

Figure 6D:
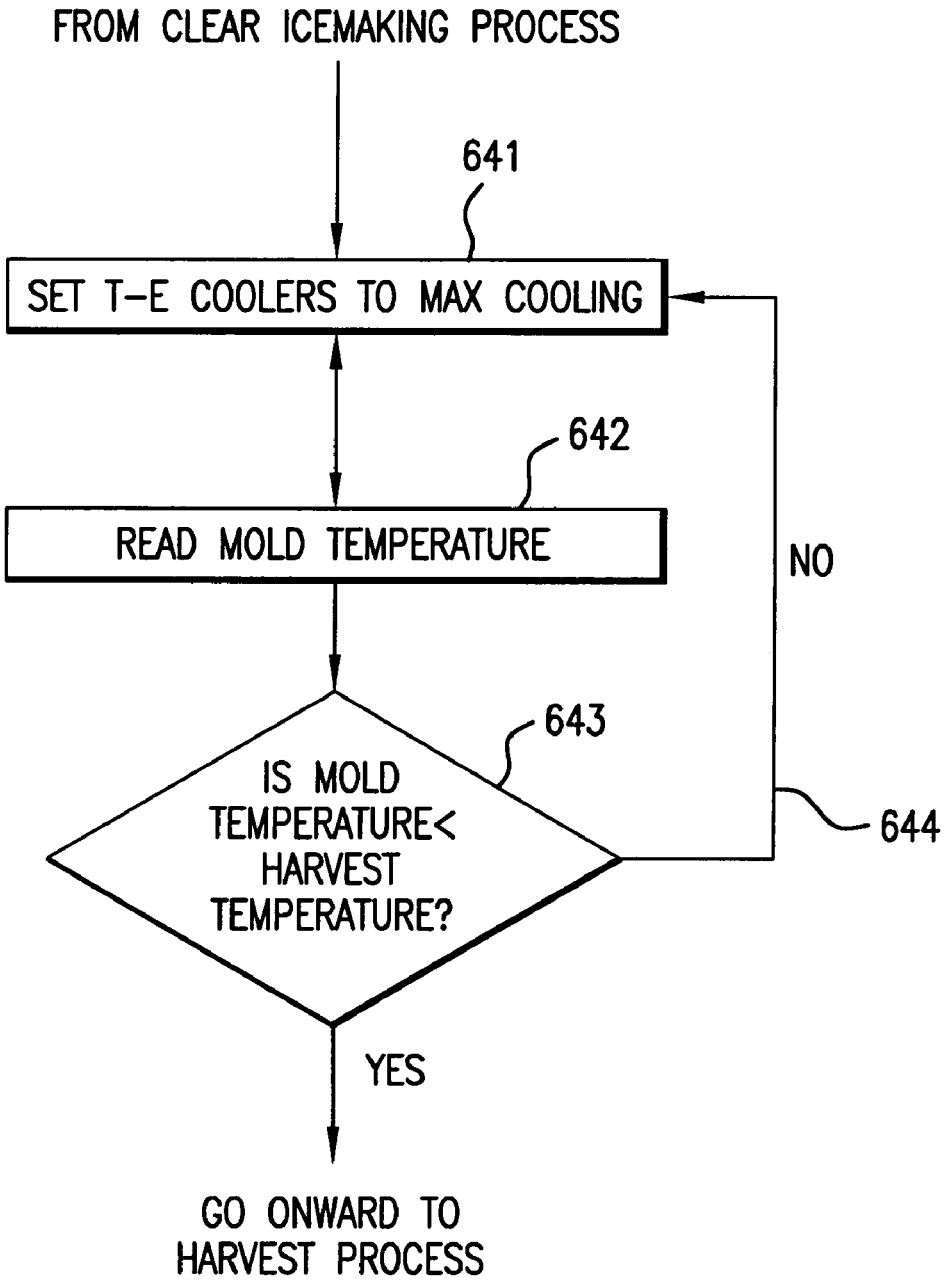
FIG. 6D is a flow chart of the ice cube sub-cooling process.

The flow chart of FIG. 6D depicts the activity required to further remove heat from the ice to achieve a suitable harvest temperature. In 641, the microcontroller 304 sets the DC power applied to the thermoelectric coolers 302 to achieve maximum cooling of the mold 301. In 642, the temperature of the mold 301 is determined by measuring a physical quality such as electrical resistance, of the calibrated mold sensor 309. In the decision block of 643, if the mold temperature is less than the harvest temperature (a value typically between 0° F. and 32° F.), the process is terminated. Otherwise, in branch 644 the thermoelectric coolers 302 continue to be operated at maximum cooling potential. When the ice reaches the harvest temperature, the process is terminated and flow of control moves onward to the harvest process shown in FIG. 6E.

Figure 6E:
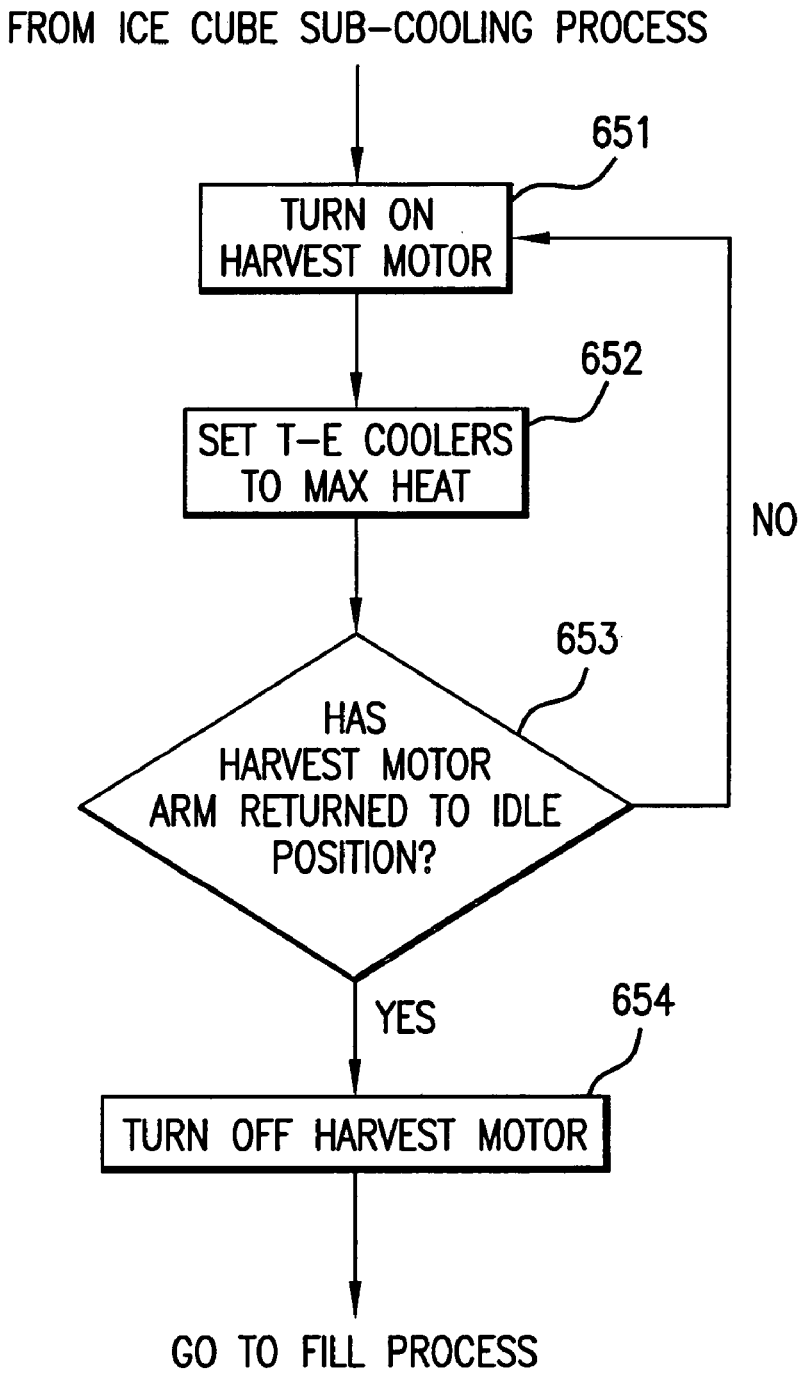
FIG. 6E is a flow chart of the harvest process.

Entered on completion of the sub-cooling process, activity in FIG. 6E describes the harvest of ice from the mold. In 651 the harvest motor 307 is energized. This causes the harvest arm 308 to rotate to directly contact and apply force to the ice frozen in the mold 301. The harvest arm 308 is connected to harvest motor 307 through a slip clutch, thereby allowing the motor 307 to operate without damage until the ice is ejected from the mold 301. In 652, the polarity of DC voltage applied to the thermoelectric coolers 302 causes the reversal of the cold and hot side. At this maximum heat mode, heat is extracted from the refrigerator ambient through heat sink 303 and the mold 301 is warmed. Once enough heat has been applied to the mold 301, the ice/mold interface melts and the cubes slip under force of the rotating harvest arm 308. When all the cubes have been ejected from the mold 301, harvest arm 308 continues to rotate to a rest position where a suitably located microswitch detects the position in 653, and transmits a signal to the microcontroller 304 which turns off harvest motor 307.

At the end of 654 in FIG. 6E, the ice making process is complete and typically restarts with a fill process as shown in FIG. 6A.

What has been described above is an embodiment of the novel aspects of the present invention. One of ordinary skill in the art will recognize that various modifications may be made to the implementation of the present invention, both in the physical components as well as the processes it performs, without departing from the scope and spirit of the claims below.

What is claimed is:

1. An ice making apparatus comprising:
   a. A mold for holding water and shaping the water as it turns to ice;
   b. A heat transfer device in thermal contact with the mold for cooling the mold at a selective rate;
   c. A processor for controlling the heat transfer device, the processor causing the heat transfer device to perform the steps of:
      i. Cooling the mold at a high rate, until the water substantially reaches its freezing temperature;
      ii. As the water freezes, cooling the mold at a lower rate; and
      iii. After the water freezes to ice, cooling the mold at a high rate, until a predefined temperature of the ice is reached.

2. The ice making apparatus of claim 1, further comprising a device for ejecting the ice from the mold.

3. The ice making apparatus of claim 1, further comprising a heat sink coupled to the heat transfer device opposite the mold.

4. The ice making apparatus of claim 3, wherein the heat sink includes fins for dissipating heat.

5. The ice making apparatus of claim 1, wherein the heat transfer device comprises a thermoelectric cooler.

6. The ice making apparatus of claim 1, wherein the heat transfer device is thermally coupled to the mold through a metal heat conducting block.

7. The ice making apparatus of claim 1, wherein the processor comprises a microcontroller.

8. The ice making apparatus of claim 1, further comprising a temperature sensor coupled to the mold, wherein the processor senses the temperature of the mold using the temperature sensor.

9. The ice making apparatus of claim 1 wherein the predefined temperature is less than 32° F.

10. The ice making apparatus of claim 1 wherein the predefined temperature is 0° F.

11. An ice making apparatus comprising:
   a. A mold for holding water and shaping the water as it turns to ice;
   b. A heat transfer device in thermal contact with the mold for selectively heating or cooling the mold;
   c. A cooling source for cooling the water in the mold; and
   d. A processor for controlling the heat transfer device as the cooling source cools the water in the mold, the processor causing the heat transfer device to perform the steps of:
      i. Cooling the mold in combination with the cooling source, until the water substantially reaches its freezing temperature;
      ii. As the water freezes, heating the mold to slow down the cooling of the water by the cooling source; and
      iii. After the water freezes to ice, cooling the mold in combination with the cooling source, until a predefined temperature of the ice is reached.

12. The ice making apparatus of claim 11, further comprising a device for ejecting the ice from the mold.

13. The ice making apparatus of claim 11, further comprising a heat sink coupled to the heat transfer device opposite the mold.

14. The ice making apparatus of claim 13, wherein the heat sink includes fins for dissipating heat.

15. The ice making apparatus of claim 11, wherein the heat transfer device comprises a thermoelectric cooler.

16. The ice making apparatus of claim 11, wherein the heat transfer device is thermally coupled to the mold through a metal heat conducting block.

17. The ice making apparatus of claim 11, wherein the cooling source uses convection to cool the water.

18. The ice making apparatus of claim 11, wherein the cooling source comprises a freezer section of a refrigeration device.

19. The ice making apparatus of claim 11, wherein the cooling source comprises a refrigeration section of a refrigeration device.

20. The ice making apparatus of claim 11, wherein the processor comprises a microcontroller.

21. The ice making apparatus of claim 11, further comprising a temperature sensor coupled to the mold, wherein the processor senses the temperature of the mold using the temperature sensor.

22. The ice making apparatus of claim 11, wherein the predefined temperature is less than 32° F.

23. The ice making apparatus of claim 11, wherein the predefined temperature is 0° F.

24. An ice making apparatus comprising:

a. A mold for holding water and shaping the water as it turns to ice;

b. A heat transfer device in thermal contact with the mold for heating the mold at a selectable rate;

c. A cooling source for cooling the water in the mold; and d. A processor for controlling the heat transfer device as the cooling source cools the water in the mold, the processor performing the steps of:

i. Once the cooling source causes the water to substantially reach its freezing temperature, activating the heat transfer device to slow down the cooling of the water by the cooling source; and ii. After the water freezes to ice, deactivating the heat transfer device.

25. The ice making apparatus of claim 24, further comprising a device for ejecting the ice from the mold.

26. The ice making apparatus of claim 24, further comprising a heat sink coupled to the heat transfer device opposite the mold.

27. The ice making apparatus of claim 26, wherein the heat sink includes fins for dissipating heat.

28. The ice making apparatus of claim 24, wherein the heat transfer device is thermally coupled to the mold through a metal heat conducting block.

29. The ice making apparatus of claim 24, wherein the cooling source uses convection to cool the water.

30. The ice making apparatus of claim 24, wherein the cooling source comprises a freezer section of a refrigeration device.

31. The ice making apparatus of claim 24, wherein the processor comprises a microcontroller.

32. The ice making apparatus of claim 24, further comprising a temperature sensor coupled to the mold, wherein the processor senses the temperature of the mold using the temperature sensor.

33. The ice making apparatus of claim 24, wherein the predefined temperature is less than 32° F.

34. The ice making apparatus of claim 24, wherein the predefined temperature is 0° F.

35. A process for making ice within a mold coupled to a heat transfer device, the process comprising the steps of:

a. Filling the mold with water;

b. Cooling the mold with the heat transfer device at a high rate, until the water substantially reaches its freezing temperature;

c. As the water freezes, cooling the mold with the heat transfer device at a lower rate;

d. After the water freezes to ice, cooling the mold with the heat transfer device at a high rate, until a predefined temperature of the ice is reached.

36. The process of claim 35, wherein the predefined temperature is less than 32° F.

37. The process of claim 35, wherein the predefined temperature is 0° F.

38. A process for making ice within a mold coupled to a heat transfer device, wherein water within the mold is cooled by a cooling source, the process comprising the steps of:

a. Filling the mold with water;

b. Cooling the mold with the heat transfer device in combination with the cooling source, until the water substantially reaches its freezing temperature;

c. As the water freezes, heating the mold with the heat transfer device, to slow down the cooling of the water by the cooling source;

d. After the water freezes to ice, cooling the mold in combination with the cooling source, until a predefined temperature of the ice is reached.

39. The process of claim 38, wherein the predefined temperature is less than 32° F.

40. The process of claim 38, wherein the predefined temperature is 0° F.

41. A process for making ice within a mold coupled to a heat transfer device, wherein water within the mold is cooled by a cooling source, the process comprising the steps of:

a. Filling the mold with water;

b. Once the cooling source causes the water to substantially reach its freezing temperature, activating the heat transfer device to slow down the cooling of the water by the cooling source;

c. After the water freezes to ice, deactivating the heat transfer device.

42. The process of claim 41, wherein the predefined temperature is less than 32° F.

43. The process of claim 41, wherein the predefined temperature is 0° F.

* * * * *